US011618931B2

(12) United States Patent
Mohanty et al.

(10) Patent No.: US 11,618,931 B2
(45) **Date of Patent: *Apr. 4, 2023**

(54) METHOD FOR PRODUCING A HIGH STRENGTH STEEL SHEET HAVING IMPROVED STRENGTH, DUCTILITY AND FORMABILITY

(71) Applicant: ArcelorMittal, Luxembourg (LU)

(72) Inventors: Rashmi Ranjan Mohanty, East Chicago, IN (US); Hyun Jo Jun, Clinton, NJ (US); Dongwei Fan, Munster, IN (US)

(73) Assignee: ARCELORMITTAL, Luxembourg (LU)

( * ) Notice: Subject to any disclaimer, the term of this patent is extended or adjusted under 35 U.S.C. 154(b) by 859 days.

This patent is subject to a terminal disclaimer.

(21) Appl. No.: 15/322,947

(22) PCT Filed: Jul. 3, 2015

(86) PCT No.: PCT/IB2015/055042

§ 371 (c)(1),
(2) Date: Dec. 29, 2016

(87) PCT Pub. No.: WO2016/001898

PCT Pub. Date: Jan. 7, 2016

(65) Prior Publication Data

US 2017/0130292 A1 May 11, 2017

(51) Int. Cl.

| | |
|---|---|
| ***C21D 9/46*** | (2006.01) |
| ***C21D 1/26*** | (2006.01) |
| ***C21D 1/25*** | (2006.01) |
| ***C22C 38/06*** | (2006.01) |
| ***C22C 38/02*** | (2006.01) |
| ***C22C 38/28*** | (2006.01) |
| ***C22C 38/26*** | (2006.01) |
| ***C21D 6/00*** | (2006.01) |
| ***C22C 38/38*** | (2006.01) |
| ***C22C 38/34*** | (2006.01) |
| ***C21D 9/48*** | (2006.01) |
| ***C21D 8/02*** | (2006.01) |
| ***C21D 1/19*** | (2006.01) |
| ***C21D 8/04*** | (2006.01) |

(52) U.S. Cl.

CPC ..... *C21D 9/46* (2013.01); *C21D 1/19* (2013.01); *C21D 1/25* (2013.01); *C21D 1/26* (2013.01); *C21D 6/002* (2013.01); *C21D 6/005* (2013.01); *C21D 6/008* (2013.01); *C21D 8/0205* (2013.01); *C21D 8/0247* (2013.01); *C21D 8/0447* (2013.01); *C21D 9/48* (2013.01); *C22C 38/02* (2013.01); *C22C 38/06* (2013.01); *C22C 38/26* (2013.01); *C22C 38/28* (2013.01); *C22C 38/34* (2013.01); *C22C 38/38* (2013.01); *C21D 2211/001* (2013.01); *C21D 2211/002* (2013.01); *C21D 2211/008* (2013.01)

(58) Field of Classification Search
None
See application file for complete search history.

(56) References Cited

U.S. PATENT DOCUMENTS

| | | | |
|---|---|---|---|
| 4,159,218 | A | 6/1979 | Chatfield |
| 8,697,252 | B2 | 4/2014 | Irie et al. |
| 9,290,834 | B2 | 3/2016 | Hasegawa et al. |
| 9,856,548 | B2 | 1/2018 | Allain et al. |
| 10,190,186 | B2 | 1/2019 | Hasegawa et al. |
| 2003/0111145 | A1 | 6/2003 | Kusinski |
| 2006/0011274 | A1 | 1/2006 | Speer et al. |
| 2008/0251161 | A1 | 10/2008 | Kashima et al. |
| 2009/0065103 | A1 | 3/2009 | Sippola |
| 2009/0238713 | A1 | 9/2009 | Kinugasa et al. |

(Continued)

FOREIGN PATENT DOCUMENTS

| | | | |
|---|---|---|---|
| CN | 101225499 | A | 7/2008 |
| CN | 101351570 | A | 1/2009 |
| CN | 101437975 | A | 5/2009 |
| CN | 101802233 | A | 8/2010 |
| CN | 101802237 | A | 8/2010 |

(Continued)

OTHER PUBLICATIONS

Edmonds D V et al: "Quenching and partitioning martensite—A novel steel heat treatment", Material Science and Engineering A: Structural Materials: Properties, Microstructure & Processing, Lausanne, CH, vol. 438-440, Nov. 25, 2006, pp. 25-34.

(Continued)

*Primary Examiner* — Anthony M Liang
(74) *Attorney, Agent, or Firm* — Davidson, Davidson & Kappel, LLC

(57) ABSTRACT

A method for producing a high strength steel sheet having a yield strength YS of at least 850 MPa, a tensile strength TS of at least 1180 MPa, a total elongation of at least 14% and a hole expansion ratio HER of at least 30%. The chemical composition of the steel contains: 0.15%≤C≤0.25%, 1.2%≤Si≤1.8%, 2%≤Mn≤2.4%, 0.1%≤Cr≤0.25%, Nb≤0.05%, Ti≤0.05%, Al≤0.50%, the remainder being Fe and unavoidable impurities. The sheet is annealed at an annealing temperature TA higher than Ac3 but less than 1000° C. for more than 30 s, by cooling it to a quenching temperature QT between 275° C. and 325° C., at a cooling speed sufficient to have, just after quenching, a structure consisting of austenite and at least 50% of martensite, the austenite content en.) being such that the final structure can contain between 3% and 15% of residual austenite and between 85 and 97% of the sum of martensite and bainite, without ferrite, heated to a partitioning temperature PT between 420° C. and 470° C. and maintained at this temperature for time between 50 s and 150 s and cooled to the room temperature.

14 Claims, 1 Drawing Sheet

(56) References Cited

U.S. PATENT DOCUMENTS

| | | | | |
|---|---|---|---|---|
| 2010/0003541 | A1 | 1/2010 | Futamura et al. | |
| 2010/0221138 | A1 | 9/2010 | Nakaya et al. | |
| 2010/0221573 | A1 | 9/2010 | Drillet et al. | |
| 2010/0263773 | A1 | 10/2010 | Cho | |
| 2010/0273024 | A1 | 10/2010 | Bocharova et al. | |
| 2011/0146852 | A1* | 6/2011 | Matsuda | C21D 6/00 148/533 |
| 2011/0220252 | A1 | 9/2011 | Hammer et al. | |
| 2014/0170439 | A1 | 6/2014 | Allain et al. | |
| 2014/0234655 | A1 | 8/2014 | Takashima et al. | |
| 2014/0322559 | A1 | 10/2014 | Becker et al. | |
| 2015/0101712 | A1 | 4/2015 | Futamura et al. | |
| 2015/0203947 | A1 | 7/2015 | Hasegawa et al. | |
| 2016/0355900 | A1 | 12/2016 | Gil Otin et al. | |
| 2017/0130290 | A1 | 5/2017 | Fan et al. | |
| 2017/0137907 | A1 | 5/2017 | Mohanty et al. | |
| 2017/0152579 | A1 | 6/2017 | Mohanty et al. | |

FOREIGN PATENT DOCUMENTS

| | | | |
|---|---|---|---|
| EP | 1707645 | A1 | 10/2006 |
| EP | 1724371 | A1 | 11/2006 |
| EP | 2202327 | A1 | 6/2010 |
| EP | 2267176 | A1 | 12/2010 |
| EP | 2325346 | A1 | 5/2011 |
| EP | 2436794 | A1 | 4/2012 |
| EP | 2524970 | A1 | 11/2012 |
| EP | 2683839 | A1 | 1/2014 |
| EP | 2881481 | A1 | 6/2015 |
| GB | 2439069 | A | 12/2007 |
| JP | 2003013177 | A | 1/2003 |
| JP | 2006083403 | A | 3/2006 |
| JP | 2007197819 | A | 8/2007 |
| JP | 2008038247 | A | 2/2008 |
| JP | 2009173959 | A | 8/2009 |
| JP | 5315956 | B2 | 6/2010 |
| JP | 2010126770 | A | 6/2010 |
| JP | 2012021225 | A | 2/2012 |
| JP | 2012031462 | A | 2/2012 |
| JP | 2012229466 | A | 11/2012 |
| JP | 2012240095 | A | 12/2012 |
| JP | 2013040383 | A | 2/2013 |
| JP | 2013237923 | A | 11/2013 |
| JP | 2014019928 | A | 2/2014 |
| JP | 2014034716 | A | 2/2014 |
| RU | 2474623 | C1 | 2/2011 |
| RU | 2518852 | C1 | 6/2014 |
| WO | 2012120020 | A1 | 9/2012 |
| WO | 2012120020 | A1 | 9/2013 |
| WO | 2013146087 | A1 | 10/2013 |
| WO | 2014020640 | A1 | 2/2014 |

OTHER PUBLICATIONS

Ning Zhong et al., "Microstructural Evolution of a Medium Carbon Advanced High Strength Steel Heat-Treated by Quenching-Partitioning Process", Aug. 16, 2013, John Wiley & Sons, Inc., Hoboken, NJ, USA, XP055166044, ISBN: 978-0-47-094309-0, pp. 885-889.

De Moore E et al., "Quench and Partitioning Response of a Mo-alloyed CMnSi Steel", New Developments on Metallurgy and Applications of High Strength Steels: Buenos Aires 2008; International Conference, May 28-28, Buenos Aires, Argentina, vol. 2, May 26, 2008, pp. 721-730.

Thomas G et al: "Alloy design for fundamental study of quenched and partitioned steels", Materials Science Technology Conferance & Exhibition, Colombus, OH, United States, Oct. 16, 2011, pp. 552-567.

Morsdorf, L., et al., "Multiple Mechanisms of Lath Martensite Plasticity." Acta Materialia, vol. 121, 2016, pp. 202-214 (Year: 2016).

Ji, Mo et al., "Effect of Grain Size Distribution on Recrystallisation Kinetics in an Fe—30Ni Model Alloy." Metals, vol. 9, No. 3, 2019, p. 369 (Year: 2019).

Garcia-Mateo et al., "On Measurement of Carbon Content in Retained Austenite in a Nanostructured Bainitic Steel," J Mater Sci, vol. 47, pp. 1004-1010 (2012).

Scott et al., "A Study of the Carbon Distribution in Retained Austenite," Scripta Materialia, vol. 56, pp. 489-492 (2007).

U.S. Appl. No. 15/322,712, filed Dec. 28, 2016, published as U.S. 2017/0137907A1 dated May 18, 2017.

U.S. Appl. No. 15/322,722, filed Dec. 28, 2016, published as US 2017/0130290A1 dated May 11, 2017.

U.S. Appl. No. 15/322,829, filed Dec. 29, 2016, published as US 2017/0152579A1 dated Mar. 11, 2017.

* cited by examiner

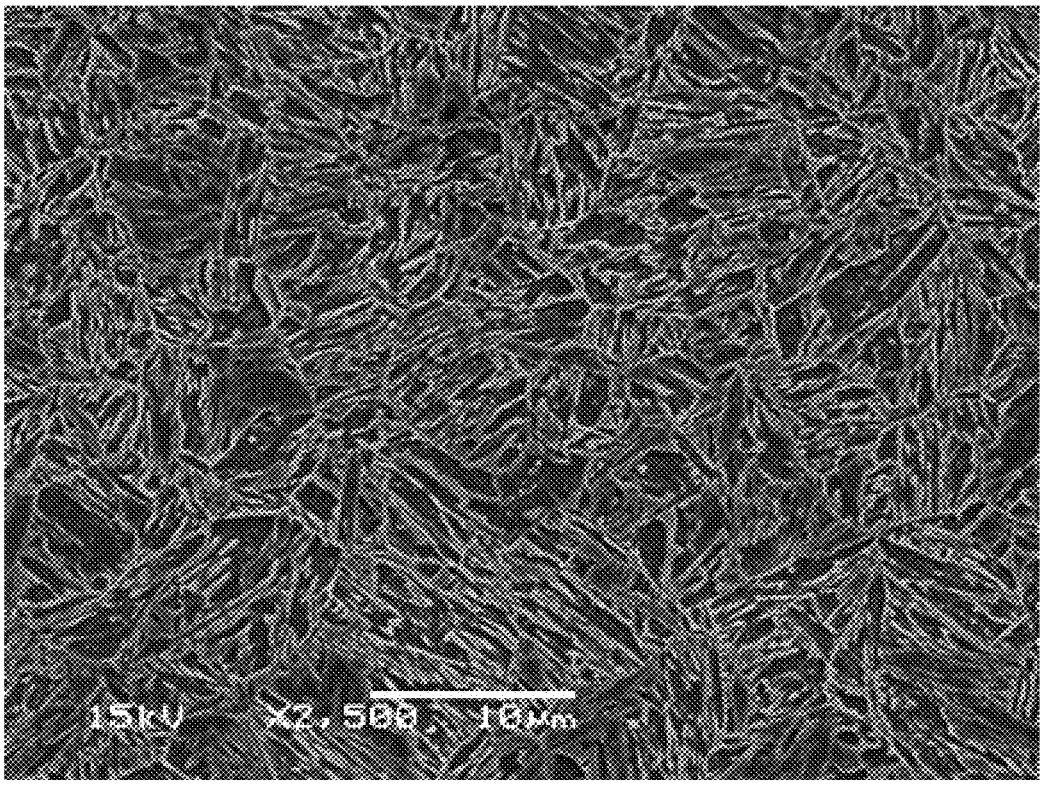
15kV X2,500 10μm

METHOD FOR PRODUCING A HIGH STRENGTH STEEL SHEET HAVING IMPROVED STRENGTH, DUCTILITY AND FORMABILITY

The present invention relates to a method for producing a high strength steel sheet having improved strength, ductility and formability and to the sheets obtained with the method.

To manufacture various equipments such as parts of body structural members and body panels for automotive vehicles, it is usual to use sheets made of DP (dual phase) steels or TRIP (transformation induced plasticity) steels.

For example, such steels which include a martensitic structure and/or some retained austenite and which contains about 0.2% of C, about 2% of Mn, about 1.7% of Si have a yield strength of about 750 MPa, a tensile strength of about 980 MPa, a total elongation of more than 8%. These sheets are produced on continuous annealing line by quenching from an annealing temperature higher than $Ac_3$ transformation point, down to a quenching temperature higher than Ms transformations point followed by heating to an overaging temperature above the Ms point and maintaining the sheet at the temperature for a given time. Then the sheet is cooled to the room temperature.

Due to the wish to reduce the weight of the automotive in order to improve their fuel efficiency in view of the global environmental conservation it is desirable to have sheets having improved yield and tensile strength. But such sheets must also have a good ductility and a good formability and more specifically a good stretch flangeability.

In this respect, it is desirable to have sheets having a yield strength YS of at least 850 MPa, a tensile strength TS of about 1180 MPa, a total elongation of at least 14% and a hole expansion ratio HER measured according to the ISO standard 16630:2009 of at least 30%. It must be emphasized that, due to differences in the methods of measure, the values of hole expansion ration HER according to the ISO standard are very different and not comparable to the values of the hole expansion ratio λ according to the JFS T 1001 (Japan Iron and Steel Federation standard).

Therefore, the purpose of the present invention is to provide such sheet and a method to produce it.

For this purpose, the invention relates to a method for producing a high strength steel sheet having an improved ductility and an improved formability, the sheet having a yield strength YS of at least 850 MPa, a tensile strength TS of at least 1180 MPa, a total elongation of at least 14% and a hole expansion ratio HER according to the ISO standard of at least 30%, by heat treating a steel sheet whose the chemical composition of the steel contains, in weight %:

0.15%≤C≤0.25%
1.2%≤Si≤1.8%
2%≤Mn≤2.4%
0.1%≤Cr≤0.25%
Nb≤0.05%
Ti≤0.05%
Al≤0.50% the remainder being Fe and unavoidable impurities. The heat treatment comprises the following steps:

annealing the sheet at an annealing temperature TA higher than Ac3 but less than 1000° C. for a time of more than 30 s, quenching the sheet by cooling it down to a quenching temperature QT between 275° C. and 325° C., at a cooling speed sufficient to have, just after quenching, a structure consisting of austenite and at least 50% of martensite, the austenite content being such that the final structure i.e. after treatment and cooling to the room temperature, can contain between 3% and 15% of residual austenite and between 85 and 97% of the sum of martensite and bainite, without ferrite, heating the sheet up to a partitioning temperature PT between 420° C. and 470° C. and maintaining the sheet at this temperature for a partitioning time Pt between 50 s and 150 s and, cooling the sheet down to the room temperature.

In a particular embodiment, the chemical composition of the steel is such that Al≤0.05%.

Preferably, the cooling speed during the quenching is of at least 20° C./s, still preferably at least 30° C./s.

Preferably, the method further comprises, after the sheet is quenched to the quenching temperature QT and before the sheet is heated up to the partitioning temperature PT, a step of holding the sheet at the quenching temperature QT for a holding time comprised between 2 s and 8 s, preferably between 3 s and 7 s. Preferably, the annealing temperature is higher than Ac3+15° C., in particular higher than 850° C.

The invention relates also to a steel sheet whose chemical composition contains in weight %:

0.15%≤C≤0.25%
1.2%≤Si ≤1.8%
2%≤Mn≤2.4%
0.1≤Cr≤0.25%
Nb≤0.05%
Ti≤0.05%
Al≤0.5% the remainder being Fe and unavoidable impurities, the sheet having a yield strength of at least 850 MPa, a tensile strength of at least 1180 MPa, a total elongation of at least 14% and a hole expansion ratio HER of at least 30% and the structure consists of 3% to 15% of retained austenite and 85% to 97% of martensite and bainite without ferrite.

The yield strength may even be greater than 950 MPa.

In a particular embodiment, the chemical composition of the steel is such that Al≤0.05%.

Preferably, the amount of carbon in the retained austenite is of at least 0.9%, preferably at least 1.0%.

Preferably, the average austenitic grain size is of at most 5 μm.

The invention will now be described in details but without introducing limitations and illustrated by the only figure which is a scanning electron microscope micrograph corresponding to example 10.

According to the invention, the sheet is obtained by hot rolling and optionally cold rolling of a semi product which chemical composition contains, in weight %:

0.15% to 0.25%, and preferably more than 0.17% and preferably less than 0.21% of carbon for ensuring a satisfactory strength and improving the stability of the retained austenite which is necessary to obtain a sufficient elongation. If carbon content is too high, the hot rolled sheet is too hard to cold roll and the weldability is insufficient.

1.2% to 1.8% preferably more than 1.3% and less than 1.6% of silicon in order to stabilize the austenite, to provide a solid solution strengthening and to delay the formation of carbides during overaging.

2% to 2.4% and preferably more than 2.1% and preferably less than 2.3% of manganese to have a sufficient hardenability in order to obtain a structure containing at least 65% of martensite, tensile strength of more than 1180 MPa and to avoid having segregation issues which are detrimental for the ductility.

0.1% to 0.25% of chromium to increase the hardenability and to stabilize the retained austenitic in order to delay the formation of bainite during overaging.

up to 0.5% of aluminum which is usually added to liquid steel for the purpose of deoxidation, If the content of Al is above 0.5%, the annealing temperature will be too high to reach and the steel will become industrially difficult to process. Preferably, the Al content is limited to impurity levels i.e. a maximum of 0.05%.

Nb content is limited to 0.05% because above such value large precipitates will form and formability will decrease, making the 14% of total elongation more difficult to reach.

Ti content is limited to 0.05% because above such value large precipitates will form and formability will decrease, making the 14% of total elongation more difficult to reach.

The remainder is iron and residual elements resulting from the steelmaking. In this respect, Ni, Mo, Cu, V, B, S, P and N at least are considered as residual elements which are unavoidable impurities. Therefore, their contents are less than 0.05% for Ni, 0.02% for Mo, 0.03% for Cu, 0.007% for V, 0.0010% for B, 0.007% for S, 0.02% for P and 0.010% for N.

The sheet is prepared by hot rolling and optionally cold rolling according to the methods known by those who are skilled in the art.

After rolling the sheets are pickled or cleaned then heat treated.

The heat treatment which is made preferably on a combined continuous annealing line comprise the steps of:

annealing the sheet at an annealing temperature TA higher than the $Ac_3$ transformation point of the steel, and preferably higher than $Ac_3$+15° C. i.e. higher than 850° C. for the steel according to the invention, in order to be sure that the structure is completely austenitic, but less than 1000° C. in order not to coarsen too much the austenitic grains. The sheet is maintained at the annealing temperature i.e. maintained between TA−5° C. and TA+10° C., for a time sufficient to homogenize the chemical composition. This time is preferably of more than 30 s but does not need to be of more than 300 s.

quenching the sheet by cooling down to a quenching temperature QT lower than the Ms transformation point at a cooling rate enough to avoid ferrite and bainite formation, The quenching temperature is between 275° C. and 325° C. in order to have, just after quenching, a structure consisting of austenite and at least 50% of martensite, the austenite content being such that the final structure i.e. after treatment and cooling to the room temperature, can contain between 3% and 15% of residual austenite and between 85 and 97% of the sum of martensite and bainite, without ferrite. The cooling rate is of at least 20° C./s, preferably at least 30° C./s. A cooling rate of at least 30° C./s is required to avoid the ferrite formation during cooling from the annealing temperature.

reheating the sheet up to a partitioning temperature PT between 420° C. and 470° C. The reheating rate can be high when the reheating is made by induction heater, but that reheating rate between 5° C./s and 20° C./s had no apparent effect on the final properties of the sheet. Thus, the reheating rate is preferably comprised between 5° C./s and 20° C./s. Preferably, between the quenching step and the step of reheating the sheet to the partitioning temperature PT, the sheet is held at the quenching temperature for a holding time comprised between 2 s and 8 s, preferably between 3 s and 7 s.

maintaining the sheet at the partitioning temperature PT for a time between 50 s and 150 s. Maintaining the sheet at the partitioning temperature means that during partitioning the temperature of the sheet remains between PT−10° C. and PT+10° C.

cooling the sheet down to room temperature with a cooling rate preferably of more than 1° C./s in order not to form ferrite or bainite. Currently, this cooling speed is between 2° C./s and 4° C./s.

With such treatment, sheets have a structure consisting of 3% to 15% of retained austenite and 85% to 97% of martensite and bainite, without ferrite. Indeed, due to the quenching under the Ms point, the structure contains martensite and at least 50%. But for such steels, martensite and bainite are very difficult to distinguish. It is why only the sum of the contents of martensite and bainite are considered. With such structure, the sheet having a yield strength YS of at least 850 MPa, a tensile strength of at least 1180 MPa, a total elongation of at least 14% and a hole expansion ratio (HER) according to the ISO standard 16630:2009 of at least 30% can be obtained.

As an example a sheet of 1.2 mm in thickness having the following composition: C=0.19%, Si=1.5% Mn=2.2%, Cr=0.2%, the remainder being Fe and impurities, was manufactured by hot and cold rolling. The theoretical Ms transformation point of this steel is 375° C. and the $Ac_3$ point is 835° C.

Samples of the sheet were heat treated by annealing, quenching and partitioning, i.e; heating to a partitioning temperature and maintaining at this temperature, and the mechanical properties were measured. The sheets were held at the quenching temperature for about 3 s.

The conditions of treatment and the obtained properties are reported at table I where the annealing type (Ann. type) column specifies if the annealing is intercritical (IA) or fully austenitic (full γ).

TABLE I

| Sample | TA ° C. | Ann. type | QT ° C. | PT ° C. | Pts | YS MPa | TS MPa | UE % | TE % | HER % | Y % | γ grain size μm | C % in γ % | B F % | M + B % |
|---|---|---|---|---|---|---|---|---|---|---|---|---|---|---|---|
| 1 | 825 | IA | 250 | 400 | 99 | 990 | 1200 | 7 | 11.7 | 24 | | | | | |
| 2 | 825 | IA | 250 | 450 | 99 | 980 | 1180 | 9 | 14 | | | | | | |
| 3 | 825 | IA | 300 | 400 | 99 | 865 | 1180 | 8.2 | 13.2 | — | | | | | |
| 4 | 825 | IA | 300 | 450 | 99 | 740 | 1171 | 10.2 | 15.4 | 13 | 12.6 | ≤5 | 1.0 | 30 | 57.4 |
| 5 | 825 | IA | 350 | 400 | 99 | 780 | 1190 | 10.1 | 15.4 | | | | | | |
| 6 | 825 | IA | 350 | 450 | 99 | 650 | 1215 | 11 | 15.5 | 8 | | | | | |
| 7 | 875 | Full Y | 250 | 400 | 99 | 1190 | 1320 | 3.5 | 8 | | | | | | |
| 8 | 875 | Full Y | 250 | 450 | 99 | 1170 | 1250 | 6.1 | 10.5 | | | | | | |
| 9 | 875 | Full Y | 300 | 400 | 99 | 1066 | 1243 | 7.2 | 12.8 | 31 | 12.3 | ≤5 | 0.98 | 0 | 87.7 |

TABLE I-continued

| Sample | TA ° C. | Ann. type | QT ° C. | PT ° C. | Pts | YS MPa | TS MPa | UE % | TE % | HER % | Y % | γ grain size μm | C % in γ % | B F % | M + B % |
|---|---|---|---|---|---|---|---|---|---|---|---|---|---|---|---|
| 10 | 875 | Full Y | 300 | 450 | 99 | 1073 | 1205 | 9.3 | 14.4 | 37 | 12 | | | | |
| 11 | 875 | Full Y | 350 | 400 | 99 | 840 | 1245 | 7.5 | 11 | | | | | | |
| 12 | 875 | Full Y | 350 | 450 | 99 | 760 | 1220 | 9.5 | 13.2 | 9 | | | | | |
| 13 | 825 | IA | 400 | 400 | 99 | 756 | 1232 | | 15.2 | 13 | | | | | |
| 14 | 825 | IA | 450 | 450 | 99 | 669 | 1285 | | 13.5 | — | | | | | |
| 15 | 875 | Full Y | 400 | 400 | 99 | 870 | 1301 | | 11.7 | 24 | | | | | |
| 16 | 875 | Full Y | 450 | 450 | 99 | 784 | 1345 | | 10.7 | — | | | | | |
| 17 | 840 | Full Y | 300 | 500 | 99 | 923 | 1170 | 7 | 9 | | | | | | |

In this table, TA is the annealing temperature, QT the quenching temperature, PT temperature of partitioning, Pt the time of partitioning, YS the yield strength, TS the tensile strength, UE the uniform elongation, TE the total elongation, HER the hole expansion ration according to the ISO standard, γ is the proportion of retained austenite in the structure, γ grain size is the average austenitic grain size, C % in γ is the amount of carbon the retained austenite, F is the amount of ferrite in the structure and M+B is the amount of the sum of martensite and bainite in the structure.

In table I, example 10 is according to the invention and all properties are better than the minimal required properties. As shown in the figure its structure contains 11.2% of retained austenite and 88.8% of the sum of martensite and bainite.

Examples 1 to 6 which are related to samples annealed at an intercritical temperature show that even if the total elongation is greater than 14%, which is the case only for samples 4, 5 and 6, the hole expansion ratio is too low.

Examples 13 to 16 which are related to prior art i.e. to sheets that were not quenched under the Ms point (QT is above the Ms point and PT is equal to QT), show that with such heat treatment, even if the tensile strength is very good (above 1220 MPa), the yield strength is not very high (below 780) when the annealing is intercritical and the formability (hole expansion ratio) is not sufficient (below 30%) in all cases.

Examples 7 to 12 which are all related to samples which were annealed at a temperature higher than $Ac_3$ i.e. the structure was completely austenitic, show that the only way to reach the targeted properties is a quenching temperature 300° C. (+/−10) and a partitioning temperature 450° C. (+/−10). With such conditions, it is possible to obtain a yield strength greater than 850 MPa and even greater than 950 MPa, a tensile strength greater than 1180 MPa, a total elongation greater than 14% and a hole expansion ratio greater than 30%. Example 17 shows that a partitioning temperature higher than 470° C. does not allow obtaining the targeted properties.

The invention claimed is:

1. A method for producing a high strength steel sheet having an improved ductility and an improved formability, the high strength steel sheet having a yield strength YS of at least 850 MPa, a tensile strength TS of at least 1180 MPa, a total elongation of at least 14% and a hole expansion ratio HER of at least 30%, comprising the steps of:

providing a steel sheet having a chemical composition including:

0.15%≤C≤0.25%;

1.2%≤Si≤1.8%;

2%≤Mn≤2.4%;

0.1%≤Cr≤0.25%;

Nb≤0.05%;

Ti≤0.05%; and

Al≤0.50%;

a remainder being Fe and unavoidable impurities;

annealing the sheet at an annealing temperature TA higher than Ac3 but less than 1000° C. for a time of more than 30 s;

quenching the sheet by cooling the sheet down to a quenching temperature QT between 275° C. and 325° C., at a cooling speed sufficient to have, just after quenching, a structure consisting of austenite and at least 50% martensite;

after the quenching, holding the sheet at the quenching temperature QT for a holding time between 3 s and 7 s;

after the holding at the quenching temperature QT, heating the sheet up to a partitioning temperature PT between 420° C. and 470° C. and maintaining the sheet at the partitioning temperature PT for a partitioning time Pt between 50 s and 150 s; and cooling the sheet down to room temperature to obtain the high strength steel sheet having a final structure consisting of between 3% and 15% retained austenite and between 85 and 97% of a sum of martensite and bainite, the final structure not including ferrite, the retained austenite having an average austenitic grain size of at most 5 μm.

2. The method according to claim 1, wherein the chemical composition of the steel includes Al≤0.05%.

3. The method according to claim 1, wherein the cooling speed during the quenching is at least 20° C./s.

4. The method according to claim 1, wherein the annealing temperature TA is higher than 850° C.

5. A steel sheet comprising:

a steel having a chemical composition including in weight %:

0.15%≤C≤0.25%;

1.2%≤Si≤1.8%;

2.1%≤Mn≤2.3%;

0.1%≤Cr≤0.25%;

Nb≤0.05%;

Ti≤0.05%; and

Al≤0.5%;

a remainder being Fe and unavoidable impurities;

a yield strength of at least 850 MPa, a tensile strength of at least 1180 MPa, a total elongation of at least 14% and a hole expansion ratio HER of at least 30%; and a structure consisting of 3% to 15% of retained austenite and 85% to 97% of martensite and bainite, the structure not including ferrite, the retained austenite having an average austenitic grain size of at most 5 μm.

6. The steel sheet according to claim 5, wherein the yield strength is greater than 950 MPa.

7. The steel sheet according to claim 5, wherein the chemical composition of the steel includes Al≤0.05%.

8. The steel sheet according to claim 5, wherein the retained austenite has a carbon content of at least 0.9%.

9. The steel sheet according to claim 8, wherein the retained austenite has a carbon content of at least 1.0%.

10. The method according to claim 3, wherein the cooling speed during the quenching is at least 30° C./s.

11. A method for producing a high strength steel sheet having an improved ductility and an improved formability, the high strength steel sheet having a yield strength YS of at least 850 MPa, a tensile strength TS of at least 1180 MPa, a total elongation of at least 14% and a hole expansion ratio HER of at least 30%, comprising the steps of:

providing a steel sheet having a chemical composition including:

0.15%≤C≤0.25%;

1.2%≤Si≤1.8%;

2%≤Mn≤2.4%;

0.1%≤Cr≤0.25%;

Nb≤0.05%;

Ti≤0.05%; and

Al≤0.5%;

a remainder being Fe and unavoidable impurities;

annealing the sheet at an annealing temperature TA higher than Ac3 but less than 1000° C. for a time of more than 30 s;

quenching the sheet by cooling the sheet down to a quenching temperature QT between 290° C. and 310° C., at a cooling speed sufficient to have, just after quenching, a structure consisting of austenite and at least 50% martensite;

after the quenching, holding the sheet at the quenching temperature QT for a holding time between 2 s and 8 s;

after the holding at the quenching temperature QT, heating the sheet up to a partitioning temperature PT between 420° C. and 470° C. and maintaining the sheet at the partitioning temperature PT for a partitioning time Pt between 50 s and 150 s; and cooling the sheet down to room temperature to obtain the high strength steel sheet having a final structure consisting of between 3% and 15% retained austenite and between 85 and 97% of a sum of martensite and bainite, the final structure not including ferrite, the retained austenite having an average austenitic grain size of at most 5 μm.

12. The method as recited in claim 11 wherein the partitioning temperature PT between 440° C. and 460° C.

13. The steel sheet according to claim 11, wherein the yield strength is greater than 950 MPa.

14. The steel sheet according to claim 11, wherein the chemical composition includes 0.17% <C<0.21%.

* * * * *